US011035202B2

(12) United States Patent
Andrew et al.

(10) Patent No.: US 11,035,202 B2
(45) Date of Patent: Jun. 15, 2021

(54) SUBSTANCE DEPOSITION AND BACKFLOW PREVENTING ARRANGEMENT AND METHOD

(71) Applicants: Colin Andrew, Cypress, TX (US); Matthew Stone, Humble, TX (US); Adam M. McGuire, Houston, TX (US)

(72) Inventors: Colin Andrew, Cypress, TX (US); Matthew Stone, Humble, TX (US); Adam M. McGuire, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 215 days.

(21) Appl. No.: 15/873,759

(22) Filed: Jan. 17, 2018

(65) Prior Publication Data

US 2019/0218886 A1 Jul. 18, 2019

(51) Int. Cl.

| | |
|---|---|
| ***E21B 34/14*** | (2006.01) |
| ***E21B 34/12*** | (2006.01) |
| ***E21B 43/12*** | (2006.01) |
| ***E21B 34/08*** | (2006.01) |
| ***E21B 34/10*** | (2006.01) |
| ***E21B 33/127*** | (2006.01) |
| ***E21B 17/20*** | (2006.01) |

(52) U.S. Cl.

CPC ..... *E21B 34/14* (2013.01); *E21B 17/20* (2013.01); *E21B 33/1277* (2013.01); *E21B 34/08* (2013.01); *E21B 34/103* (2013.01); *E21B 34/12* (2013.01); *E21B 43/129* (2013.01); *E21B 2200/06* (2020.05)

(58) Field of Classification Search

CPC ..... E21B 17/20; E21B 2034/007; E21B 33/1277; E21B 34/08; E21B 34/12; E21B 34/14; E21B 43/129

See application file for complete search history.

(56) References Cited

U.S. PATENT DOCUMENTS

| | | | | |
|---|---|---|---|---|
| 7,021,389 | B2 | 4/2006 | Bishop et al. | |
| 2004/0163820 | A1* | 8/2004 | Bishop | E21B 34/06 166/373 |
| 2006/0201557 | A1* | 9/2006 | Shieh | F16K 15/04 137/533.11 |
| 2006/0213670 | A1 | 9/2006 | Bishop et al. | |
| 2012/0012771 | A1 | 1/2012 | Korkmaz et al. | |

(Continued)

FOREIGN PATENT DOCUMENTS

WO 2009132462 A1 11/2009

OTHER PUBLICATIONS

Notification of Transmittal of the International Search Report and the Written Opinion of the International Searching Authority, or the Declaration; PCT/US2018/063238: dated Mar. 19, 2019; 17 pages.

*Primary Examiner* — Caroline N Butcher

(74) *Attorney, Agent, or Firm* — Cantor Colburn LLP

(57) ABSTRACT

A substance deposition and backflow preventing arrangement including a housing having a port therein, a sleeve disposed within the housing and positionable to cover or uncover the port, the sleeve having a first seal at one end thereof presenting a first hydraulic dimension and a second seal at another end of the sleeve having a different hydraulic dimension, a biasing member operably connected to the sleeve and to the housing and configured to urge the sleeve to a position covering the port.

12 Claims, 5 Drawing Sheets

(56) References Cited

U.S. PATENT DOCUMENTS

| | | | | |
|---|---|---|---|---|
| 2013/0025877 | A1* | 1/2013 | Robinson-Brown | E21B 34/14<br>166/373 |
| 2013/0037273 | A1* | 2/2013 | Themig | E21B 34/08<br>166/373 |
| 2015/0167428 | A1* | 6/2015 | Hofman | E21B 34/16<br>166/373 |
| 2015/0345252 | A1* | 12/2015 | McNabb | E21B 34/12<br>166/318 |
| 2017/0241238 | A1* | 8/2017 | Bacsik | E21B 34/10 |

* cited by examiner

SUBSTANCE DEPOSITION AND BACKFLOW PREVENTING ARRANGEMENT AND METHOD

BACKGROUND

In the drilling and completion industry, there is often the need to dispose of mud and other operative fluids and particulate matter ("substance(s)") when an operation is completed and regulations do not require the recovery of the substances to surface. In such situations, it may be desirable to "park" that substance downhole in an annular area of the borehole that is not in a target fluid bearing formation. This has been done in the art but there is always difficulty in keeping the substance in the annulus since it tends to want to flow back into the production tubing. The art would well receive alternative arrangements that facilitate deposition of such substances while avoiding the pitfalls of prior art technology.

SUMMARY

A substance deposition and backflow preventing arrangement including a housing having a port therein, a sleeve disposed within the housing and positionable to cover or uncover the port, the sleeve having a first seal at one end thereof presenting a first hydraulic dimension and a second seal at another end of the sleeve having a different hydraulic dimension, a biasing member operably connected to the sleeve and to the housing and configured to urge the sleeve to a position covering the port.

A substance deposition and backflow preventing arrangement including a housing having a port therein, a sleeve disposed within the housing and positionable to cover or uncover the port, the sleeve having a first seal at one end thereof presenting a first hydraulic dimension and a second seal at another end of the sleeve having a different hydraulic dimension, a convertible ball seat system disposed within the housing.

A substance deposition and backflow preventing arrangement including a housing having a port and a check valve therein, a first sleeve having a first ball seat disposed within the housing, the sleeve movable between positions covering the port and uncovering the port, and a second sleeve having a second ball seat within the housing, the sleeve movable between positions covering the check valve and covering the port.

A borehole system including a tubing string disposed in the borehole, and a substance deposition and backflow preventing arrangement disposed as a part of the tubing string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
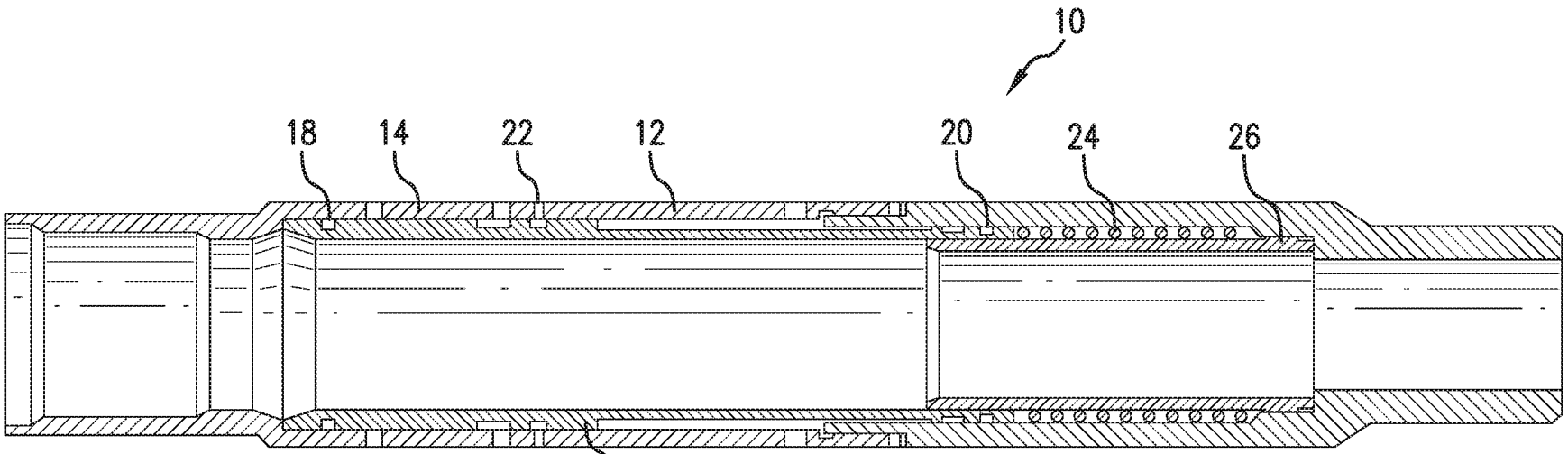
FIG. 1 is a cross sectional view of a substance deposition and backflow preventing arrangement.

Referring to FIG. 1, a first embodiment of a substance deposition and backflow preventing arrangement 10. The arrangement 10 includes a housing 12 with a port 14. A sleeve 16 is slidably disposed within the housing 12 and includes a seal 18 at one end having a first piston dimension and a seal 20 at an opposite end of the sleeve 16 having a slightly smaller hydraulic dimension. A release member 22 secures the sleeve 16 in an initial position (depicted) in the housing 12 until released. Release may be occasioned by pressure increase acting on the sleeve, which causes a movement moment due to the unequal hydraulic dimensions of the seals 18 and 20 versus annulus pressure. Once a threshold force is generated on the release member 22, it will release and allow the sleeve 16 to move. In an embodiment the release member 22 is a shear screw. Upon continued application of hydraulic pressure on the arrangement 10, the sleeve 16 will move sufficiently to expose the port 14 whereafter substances to be discarded to the annulus (non target fluid bearing portion of formation) may be pumped through the port 14. When pressure becomes equalized between tubing and annulus, the impetus for the sleeve remaining open is lost and the sleeve 16 may close. It is the duty of a biasing member 24 to bias the sleeve 16 back to the closed position. It will be evident to those of skill in the art that the force of the applied pressure also must initially overcome the biasing member 24 when opening the sleeve 16. A protection sleeve 26 may be added in some iterations to protect the biasing member 24 from debris that might otherwise impede its performance.

Because of the biasing member 24, the substances destined to be parked in the annulus can be pumped through the port 14 and then after pressure equalizes, the sleeve 16 will close over port 14 and prevent any flowback of the substances into the tubing string. The arrangement 10 is also open so that circulation from above remains possible.

Figure 2:
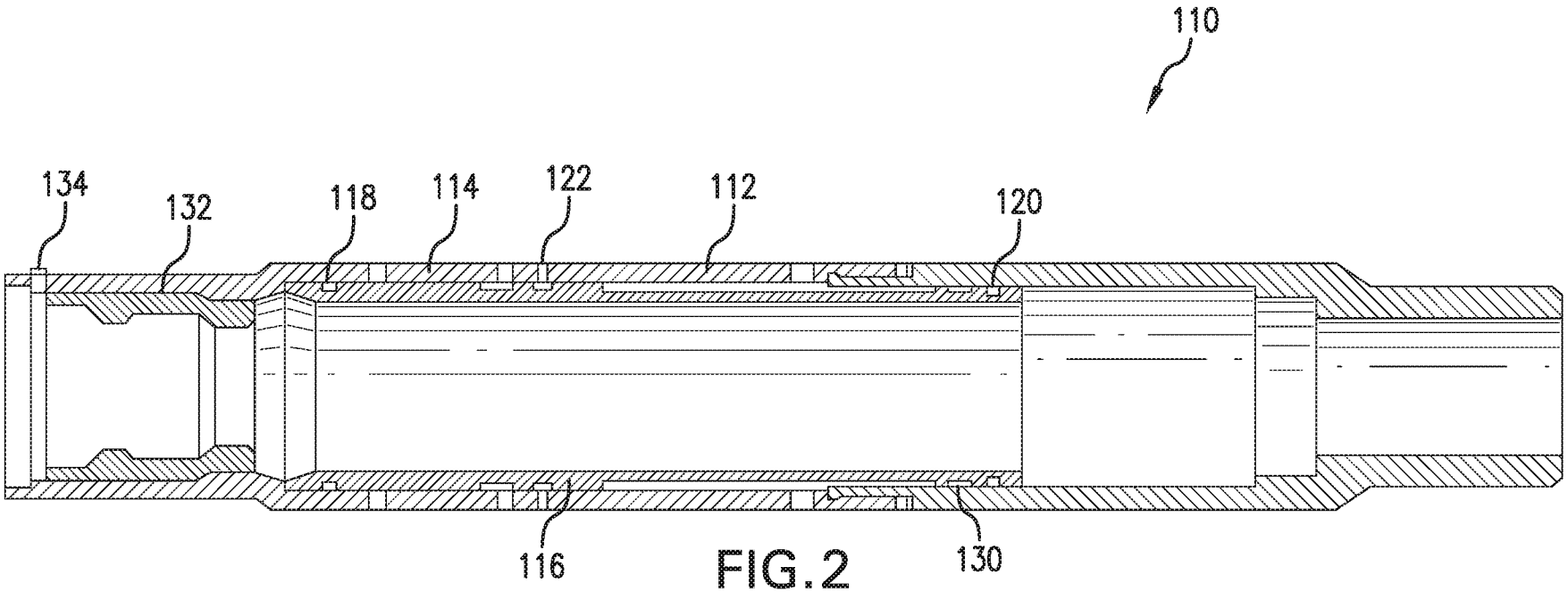
FIG. 2 is a schematic line drawing of a collet and ball arrangement in conjunction with a commercially available "P sleeve;"

Referring to FIG. 2, a somewhat similar embodiment of the arrangement is illustrated as numeral 110. The arrangement 110 includes a housing 112 with a port 114. A sleeve 116 is slidably disposed within the housing 112 and includes a seal 118 at one end having a first piston dimension and a seal 120 at an opposite end of the sleeve 116 having a slightly smaller hydraulic dimension. A release member 122 secures the sleeve 116 in an initial position (depicted) in the housing 112 until released. Release may be occasioned by pressure increase acting on the sleeve 116, which causes a movement moment due to the unequal hydraulic dimensions of the seals 118 and 120 versus annulus pressure. Once a threshold force is generated on the release member 122, it will release and allow the sleeve 116 to move. In an embodiment the release member 122 is a shear screw. Upon continued application of hydraulic pressure on the arrangement 110, the sleeve 116 will move sufficiently to expose the port 114 whereafter substances to be discarded to the annulus (non target fluid bearing portion of formation) may be pumped through the port 114. In this embodiment, the sleeve 116 does not close but rather is locked open through profile 130.

Arrangement 110 further includes a convertible ball seat system 132 that is initially maintained in place with a seat release member 134, which may be a shear screw. Further edification regarding convertible ball seat system 132 is provided below with reference to FIG. 3.

Figure 3:
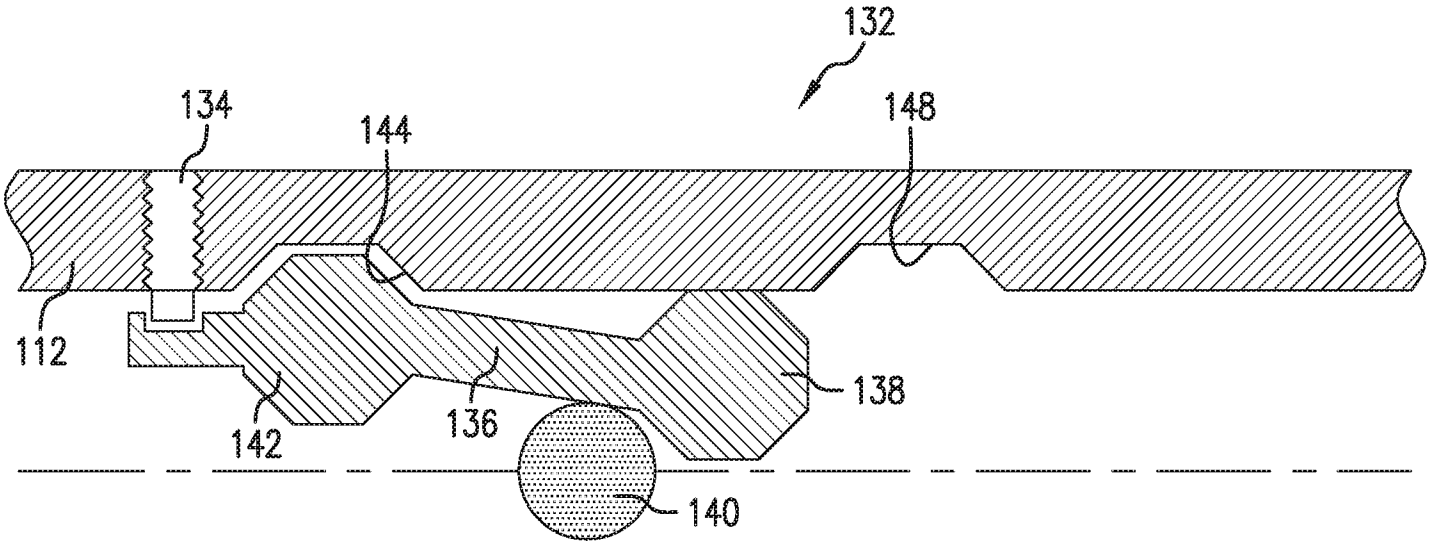
FIG. 3 is a schematic enlarged view of the collet mechanism illustrated in FIG. 2 in a first position.
Figure 4:
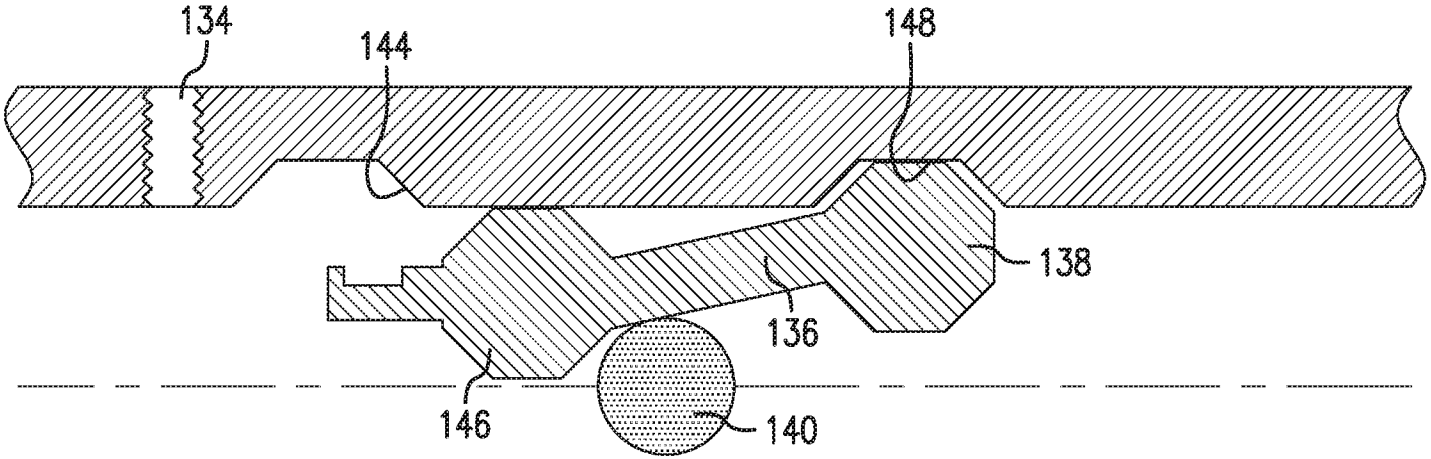
FIG. 4 is a schematic enlarged view of the collet mechanism illustrated in FIG. 2 in a second position.
Figure 5:
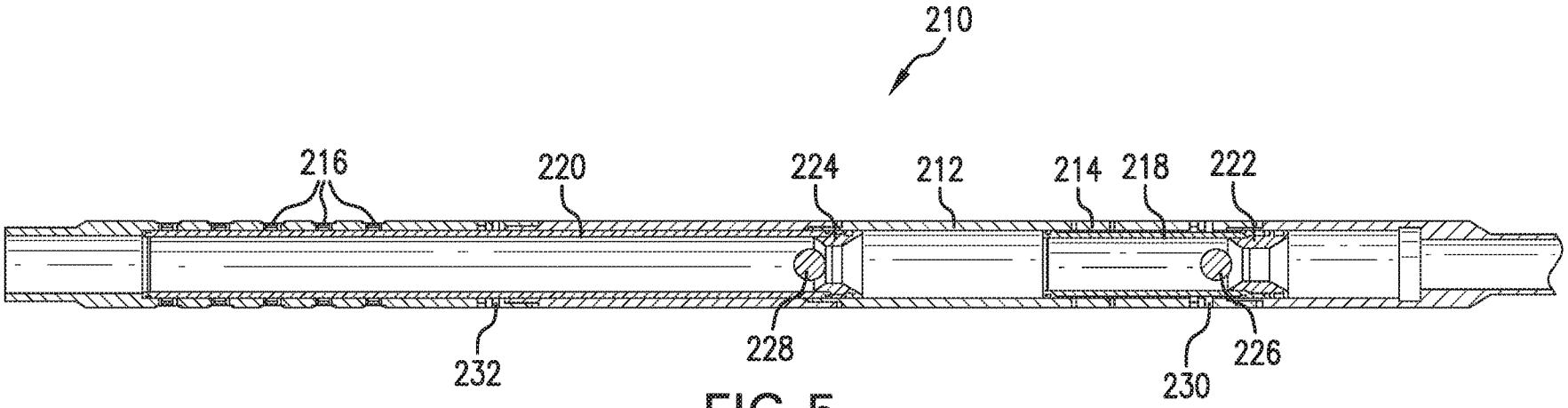
FIG. 5 is a cross sectional view of another embodiment of a substance deposition and backflow preventing arrangement.
Figure 6:
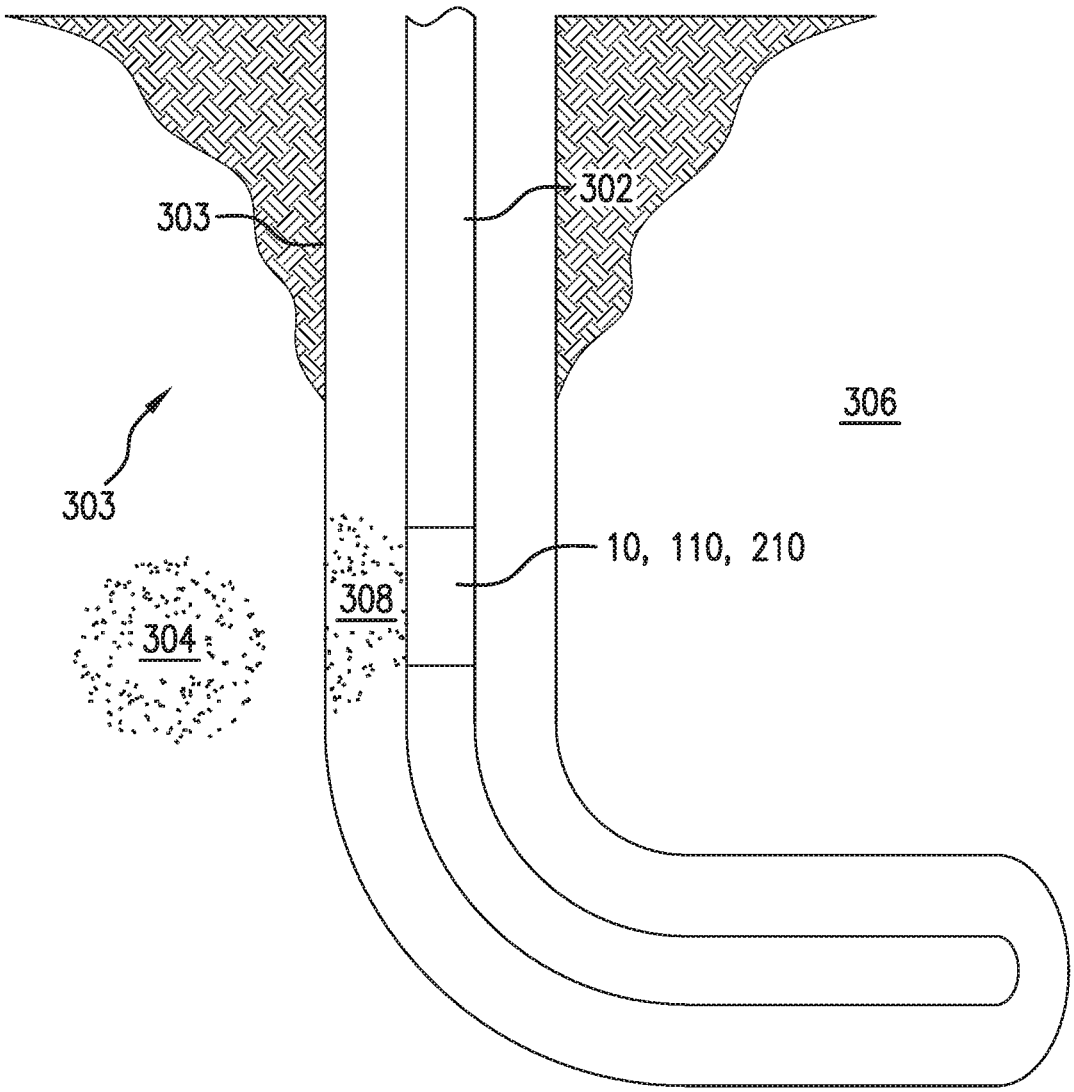
FIG. 6 is a schematic representation of a borehole system including an arrangement as disclosed herein.

Referring to FIG. 3, one embodiment of the convertible ball seat system 132 is illustrated in an enlarged view. In each case the convertible ball seat system will present a seat to a dropped ball that will allow for a pressure event to shift the system into a second configuration wherein the ball is captured by the first seat though not sealed to it and is presented with another seat now uphole of the ball and against which sealing will occur is flow moves the ball in that direction. The system 132 hence presents a check valve to allow circulation flow downhole while preventing flow back uphole. As illustrated in FIG. 5, the system 132 uses a collet configuration having fingers 136 initially forming a seat 138 for a ball 140. The fingers 136 extend to a check seat 142, which seat is disposed in a recess 144 of the housing 112 to ensure initial passage of the ball 140. Finally, the fingers 136 include a release tab 146 initially connected to seat release member 134. Upon landing a ball 140 on the seat 138 and pressuring sufficiently to release the seat release member 134, the system 132 shifts to move the seat 138 into recess 148 of housing 112 and bring check seat 142 radially inwardly (see FIG. 4). It should be appreciated in the FIGS. 3 and 4 that recess 148 is shallower than recess 144. This is because recess 144 is intended to position the check seat 142 initially such that the ball diameter can pass through the seat 142. With recess 148, the intent is that the ball 140 remains captured by the seat 138 but that it does not seal against the ball 140 but rather allows fluid to move past the ball in the downhole direction. This is what ensures circulation from above is facilitated. When check seat 142 is removed from the recess 144, it will be sufficiently reduced in diameter that it will seal against the ball 140 in the event flow urges the ball back in the uphole direction. Hence the check seat 142 is a check valve with the ball 140. Accordingly, substance may be pumped downhole and through port 114, leaving the port 114 permanently open but then dropping a ball 140 on the seat 138, shifting the seat to convert the system 132 to a check valve with the ball so that no substance can flow back uphole.

Referring to FIG. 5, another arrangement is illustrated as 210. Arrangement 210 includes a housing 212 having a port 214 therein. The housing 212 further includes a check valve 216. There are two movable sleeves, 218 and 220, and two ball seats 222 and 224, respectively. The ball seats are not the same size so that the intended operation is facilitated. Ball seat 222 is configured to mate with a smaller ball than ball seat 224. This allows for a smaller ball 226 to be dropped through the seat 224 and land on seat 222 and a larger ball 228 to subsequently be dropped and land on seat 224. Each sleeve 218 and 220 has a release member 230, 232 associated therewith. These release members 230, 232 are similar to those discussed above in other embodiments. Accordingly upon sufficient threshold force on the associated sleeve, the release member will release and allow the associated sleeve to move. The force in this case is generated by a buildup of fluid pressure against a seated ball. The first ball 226 is dropped to seat 222 and through hydraulic input causes the sleeve 218 to move downhole revealing port 214. Substances to be parked may then be pumped through the port 214. Subsequent to pumping the substances into the annulus about the housing 212, the second ball 228 is caused to land on seat 224 whereafter a pressure event will cause release member 232 to release allowing sleeve 220 to move downhole and cover the port 214. This prevents the substance from flowing back to the tubing. Due to the balls on seats in this embodiment however, it may be noted by readers that the ability to circulate fluid above the arrangement 210 would apparently be compromised. This is addressed in that check valves 216 are positioned through the housing 212 and uncovered by the movement of sleeve 220. Circulation is facilitated and yet the port 214 is permanently closed by sleeve 220.

Any of the arrangements 10, 110, 210 discussed hereinabove may be employed as a part of a borehole system 300 wherein the arrangement is a part of a tubing string 302, which may be a drill string or a production string within a borehole 303. The arrangement will be positioned adjacent a non producing zone 304 of a formation 306 so that substances 308 (drilling mud, excess treatment chemicals, milling junk, etc.) may be disposed of and prevented from migrating back into the tubing 302.

Set forth below are some embodiments of the foregoing disclosure:

Embodiment 1

A substance deposition and backflow preventing arrangement including a housing having a port therein, a sleeve disposed within the housing and positionable to cover or uncover the port, the sleeve having a first seal at one end thereof presenting a first hydraulic dimension and a second seal at another end of the sleeve having a different hydraulic dimension, a biasing member operably connected to the sleeve and to the housing and configured to urge the sleeve to a position covering the port.

Embodiment 2

The arrangement as in any prior embodiment wherein the sleeve further includes a release member configured to maintain a first position of the sleeve until an input causes release of the release member.

Embodiment 3

The arrangement as in any prior embodiment wherein the second seal presents a smaller hydraulic dimension.

Embodiment 4

The arrangement as in any prior embodiment wherein the biasing member is a compression spring.

Embodiment 5

The arrangement as in any prior embodiment further including a protector sleeve disposed to cover the biasing member.

Embodiment 6

A substance deposition and backflow preventing arrangement including a housing having a port therein, a sleeve disposed within the housing and positionable to cover or uncover the port, the sleeve having a first seal at one end thereof presenting a first hydraulic dimension and a second seal at another end of the sleeve having a different hydraulic dimension, a convertible ball seat system disposed within the housing.

Embodiment 7

The arrangement as in any prior embodiment wherein the sleeve further includes a release member configured to maintain a first position of the sleeve until an input causes release of the release member.

Embodiment 8

The arrangement as in any prior embodiment wherein the second seal presents a smaller hydraulic dimension.

Embodiment 9

The arrangement as in any prior embodiment wherein the convertible ball seat system comprises a first operative position to convert the seat and a second operative position to act as a check valve with a ball dropped therein.

Embodiment 10

The arrangement as in any prior embodiment wherein the convertible ball seat system comprises fingers having a first seat on one end thereof and a check seat on another end thereof, the first seat being sealable with a dropped ball to convert the system and the second seat being sealable with the ball to prevent backflow through the arrangement.

Embodiment 11

The arrangement as in any prior embodiment further comprising a release member connected to the convertible ball seat system.

Embodiment 12

A substance deposition and backflow preventing arrangement including a housing having a port and a check valve therein, a first sleeve having a first ball seat disposed within the housing, the sleeve movable between positions covering the port and uncovering the port, and a second sleeve having a second ball seat within the housing, the sleeve movable between positions covering the check valve and covering the port.

Embodiment 13

The arrangement as in any prior embodiment wherein the first ball seat is of smaller dimension than the second ball seat.

Embodiment 14

The arrangement as in any prior embodiment wherein each sleeve further includes a release member configured to maintain an initial position of the associated sleeve until an occurrence of a selected input.

Embodiment 15

The arrangement as in any prior embodiment wherein the check valve allows fluid flow radially outwardly of the housing and not radially inwardly of the housing.

Embodiment 16

A borehole system including a tubing string disposed in the borehole, and a substance deposition and backflow preventing arrangement disposed as a part of the tubing string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A substance deposition and backflow preventing arrangement comprising:

a housing having a port therein;

a sleeve disposed within the housing and positionable to cover or uncover the port, the sleeve having a first seal at one end thereof presenting a first hydraulic dimension and a second seal at another end of the sleeve having a different hydraulic dimension;

a convertible ball seat system disposed within the housing the system including a plurality of fingers each having a first end and a second end, each finger forming a portion of a first seat on the first end of each finger of the plurality of fingers and a portion of a check seat on the second end of each finger of the plurality of fingers, the first seat being sealable with a dropped ball to convert the system and the second seat being sealable with the ball to prevent backflow through the arrangement.

2. The arrangement as claimed in claim 1 wherein the sleeve further includes a release member configured to maintain a first position of the sleeve until an input causes release of the release member.

3. The arrangement as claimed in claim 1 wherein the second seal presents a smaller hydraulic dimension.

4. The arrangement as claimed in claim 1 wherein the convertible ball seat system comprises a first operative position wherein the first seat is sealingly receptive to the dropped ball and a second operative position wherein the first seat retains the dropped ball but allows flow past the dropped ball simultaneously with the second seat becoming sealingly receptive of the dropped ball so that the convertible ball system becomes a check valve with a ball dropped therein.

5. The arrangement as claimed in claim 1 further comprising a release member connected to the convertible ball seat system.

6. The arrangement as claimed in claim 1 further comprising:

a second sleeve having a second ball seat within the housing, the sleeve movable between positions covering a check valve and covering the port.

7. The arrangement as claimed in claim 6 wherein the first ball seat is of smaller dimension than the second ball seat.

8. The arrangement as claimed in claim 6 wherein each sleeve further includes a release member configured to maintain an initial position of the associated sleeve until an occurrence of a selected input.

9. The arrangement as claimed in claim 6 wherein the check valve allows fluid flow radially outwardly of the housing and not radially inwardly of the housing.

10. A borehole system comprising:

a tubing string disposed in the borehole; and a substance deposition and backflow preventing arrangement as claimed in claim 1 disposed as a part of the tubing string.

11. A convertible ball seat system comprising:

a housing;

a plurality of fingers disposed in the housing each having a first end and a second end, each finger forming a portion of a first seat on the first end of each finger of the plurality of fingers and a portion of a check seat on the second end of each finger of the plurality of fingers, the first seat being sealable with a dropped ball to convert the system and the second seat being sealable with the ball to prevent backflow through the system.

12. The system as claimed in claim 11 wherein the housing includes a recess engagable with the first ends of each finger of the plurality of fingers and a second recess engagable with the second ends of each finger of the plurality of fingers and engagement of the first ends of each finger of the plurality of fingers with the first recess causes the first seat to allow flow past the dropped ball while engagement of the second ends of each finger of the plurality of fingers with the second recess causes the second seat to allow passage of the dropped ball into the convertible ball seat system.

* * * * *